US005752632A

United States Patent [19]

Sanderson et al.

[11] Patent Number: 5,752,632

[45] Date of Patent: May 19, 1998

[54] TACTICAL RADIO MICROPHONE HOLDER

[76] Inventors: Douglas James Sanderson, 14684 Castroville Blvd., Castroville, Calif. 95012; Anastacio Medina, Jr., P.O. Box 223244, Carmel, Calif. 93923

[21] Appl. No.: 520,980

[22] Filed: Aug. 1, 1995

[51] Int. Cl.[6] ..... A45F 5/02

[52] U.S. Cl. ..... 224/182; 224/251; 224/197; 224/930; 24/3.1; 24/197; D3/215; D3/218

[58] Field of Search ..... 224/182, 185, 224/904, 269, 660, 268, 251, 616, 617, 197, 255, 256, 930; 24/17 B, 324, 197, 3.1; D3/228, 225, 215, 220, 218; 2/251

[56] References Cited

U.S. PATENT DOCUMENTS

| | | | |
|---|---|---|---|
| 652,891 | 7/1900 | Cochran | 224/251 |
| 1,010,763 | 12/1911 | Hogan | 224/904 |
| 2,099,029 | 11/1937 | McKay . | |
| 2,767,902 | 10/1956 | Hiersteiner . | |
| 4,100,653 | 7/1978 | Sensabough . | |
| 4,408,706 | 10/1983 | Hurley | 224/904 |
| 4,757,927 | 7/1988 | Rutty | 224/904 |
| 4,790,461 | 12/1988 | Stover | 224/241 |
| 5,100,037 | 3/1992 | Kopyta et al. | 224/245 |
| 5,450,994 | 9/1995 | Malinowski | 224/269 |

OTHER PUBLICATIONS

Catalog of Mathis Klein & Sons Inc., p. 51, Snap Loop ( fig. H), Feb. 1976.

*Primary Examiner*—Charles R. Eloshway
*Attorney, Agent, or Firm*—LaRiviere, Grubman & Payne

[57] ABSTRACT

Method and apparatus for releasably attaching electronic components to a user's clothing. The apparatus enables an electronic component, for instance a tactical radio microphone, to be releasably attachable to a user's clothing by one of the buttons thereof. The apparatus defines a slot for engaging a wearer's button and a ring or other keeper device for receiving therein the clip of a microphone or other electronic component. The body of the apparatus is sized to minimize rotation of the microphone or other electronic device around the axis of its rotation formed by its clip and the wearer's garments.

3 Claims, 2 Drawing Sheets

TACTICAL RADIO MICROPHONE HOLDER

TECHNICAL FIELD

The present invention relates to an apparatus for releasably attaching articles, such as electronic apparatus to a wearer's apparel. More particularly, the present invention teaches a holder for releasably attaching a microphone to a wearer's clothing while minimizing the damage to the user's clothing caused by the microphone clip. Furthermore, the present invention provides advantages in assisting a user to rapidly locate such a microphone while being worn.

BACKGROUND ART

Advances in electronic design have, in recent years, enabled the production of small tactical radios for use by police and security personnel. These tactical radios enable a user to maintain real time communication with a central dispatch office without regard to the user's proximity to a vehicle mounted radio. While some tactical radios are manufactured and sold as a one piece unit, e.g., a walkie-talkie type radio, many officers prefer the flexibility and reduced bulk of a unit which employs a separate microphone.

Tactical radios, especially those utilizing a separate microphone are typically worn at the user's belt, and the microphone, attached thereto by a flexible wire, is typically releasably attached in the vicinity of one of the user's shoulders. This enables the user to establish and maintain real time communications with his or her dispatch station simply by grasping the microphone, depressing the key, and talking into the microphone already attached substantially near to the user's mouth. By way of example but not limitation, several such radios and remote microphones are manufactured and sold by Motorola, Inc.

In order to accomplish this rapid access to the microphone, radio and microphone manufacturers typically employ some form of spring mounted clip at the rear of the microphone for attaching that microphone to the user's apparel. One such clip device is disclosed in U.S. Pat. No. 4,100,653 to Sensabaugh. Similar to many such clip arrangements, Sensabaugh teaches a clip pivotally mounted to a spring, the spring being attached to the rear surface of a microphone. The clip is for engaging the rear of the microphone and for holding therebetween the material of the user's apparel.

While microphone clips of the type illustrated by Sensabaugh will ensure a reasonably secure attachment to a wearer's apparel, they do present some problems for the user. First, because the clip is narrow relative to the microphone body, the microphone, particularly during running or other vigorous physical activity, tends to rotate about the axis formed by the narrow clip and the wearer's clothing. This has the effect of making the microphone more difficult to find in stress situations, thereby requiring more of the officer's attention than is otherwise desirable to establish communications with his or her central dispatch station.

A second problem, particularly irksome to police and security officers, is the fact that in order to maintain the previously discussed attachment to the officer's clothing, the clip must impart a strong gripping force in practice, the required grip is such that the normal motion of the microphone over the course of several days use tends to rapidly wear that portion of the clothing to which it is attached.

Finally, it is not uncommon for an officer involved in an altercation with a suspect to find that during the course of the altercation his or her clothing has been torn by the microphone clip. This is due to the strong gripping force applied by some microphone clips, which when pulled exerts sufficient force to tear the clothing to which it is attached.

What is needed is a method or apparatus for removably attaching equipment, particularly a tactical radio microphone, to an officer's clothing in such a manner that the equipment is instantly accessible for use without undue attention from the officer to locate that equipment. Furthermore, such a method or apparatus should be capable of attaching the microphone or other equipment to the wearer's clothing without imposing undo wear thereupon. Finally, the apparatus should be capable of minimizing damage to the wearer's apparel caused by pulling on the microphone or other equipment in the event of an altercation or other mischance.

DISCLOSURE OF INVENTION

The present invention provides a method for releasably attaching an apparatus, for instance a tactical radio or it's microphone to a wearer's apparel in such manner as to minimize the effort required to locate and actuate the device and a holder to perform the method. Furthermore, the apparatus holder, hereafter referred to as a microphone holder, performs this attachment such that wear to the user's clothing is minimized. Finally, in the event of a microphone mounted to the present invention being caught or pulled in an altercation, damage to the user's clothing is further minimized by the fact that use of the present invention tends to minimize such damage to the replacement of lost buttons.

The present invention comprises a flat or planar body defining an elongate aperture through which a button on a user's garment may be inserted therethrough, thereby removably attaching the body to the user's clothing. The body further has disposed thereon a keeper for receiving therein the securing device, such as a clip or grip, of a tactical radio microphone or other apparatus. One embodiment of the present invention includes the flat body attached to one portion of the elongate arm.

An upper end of the body, for instance the elongate arm, has disposed upon it a means for attaching the device to a button on a user's apparel. In one embodiment, the elongate arm defines a slit or elongate aperture therethrough. This elongate aperture may be sized to pass therethrough commonly sized uniform buttons.

By forming the body of the present invention such that it is somewhat larger in outline than the outline of the article or apparatus which will be attached thereto, the tendency of the apparatus to rotate about it's securing device is minimized.

One methodology for receiving therein the clip of a microphone is a ring swivelably mounted to the body of the microphone holder of the present invention. The ring is sized to admit therethrough the clip or gripping device of a tactical radio microphone thereby minimizing rotation of the microphone about its clip during vigorous physical activity. The body and elongate arm of the present invention may be of unitary construction, may be formed of two or more pieces permanently attached, or may be formed of two or more pieces removably attached. Alternatively, the ring of the present invention may be replaced with at least one horizontal elongate aperture or slit for receiving therein the microphone clip, thereby securing the microphone to the body of the invention.

The present invention may be formed from a wide variety of flexible and rigid materials including leather, plastics, metal, fabric, or a combination thereof. The ring of the present invention may be formed of metal, plastic, or other material well known to those of ordinary skill in the art.

Other features of the present invention are disclosed or apparent in the section entitled: "BEST MODE FOR CARRYING OUT THE PRESENT INVENTION."

BRIEF DESCRIPTION OF DRAWINGS

For fuller understanding of the present invention, reference is made to the accompanying drawing in the following detailed description of the Best Mode of Carrying Out the Present Invention. In the drawing.

Figure 1:
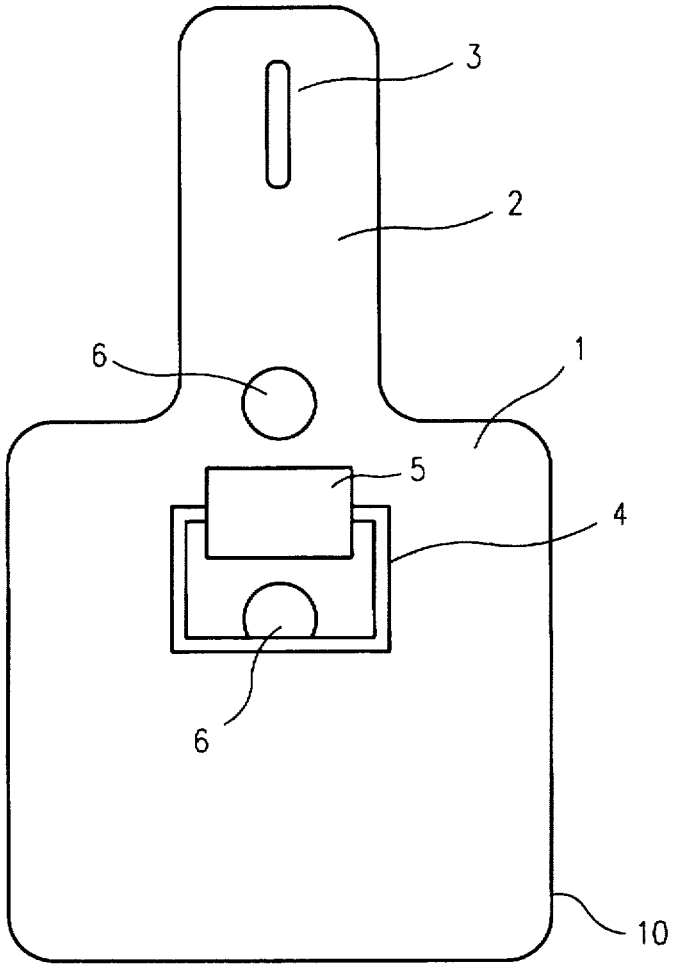
FIG. 1 is a plan view of the present invention.

Reference numbers refer to the same or equivalent parts of the present invention throughout the several figures of the drawing.

BEST MODE FOR CARRYING OUT THE PRESENT INVENTION

Referring now to FIG. 1, the preferred embodiment of the present invention comprising tactical microphone holder 10 is detailed. In the preferred embodiment, holder 10 is formed of body 1 and elongate arm 2 in unitary construction, and formed of belting leather. A vertical elongate aperture 3 is defined at the upper (i.e., distal or outboard) end of elongate arm 2. Vertical elongate aperture 3 is sized to receive therein said commonly sized uniform buttons. Body 1 has swivelably mounted thereto a substantially square ring 4.

Figure 2:
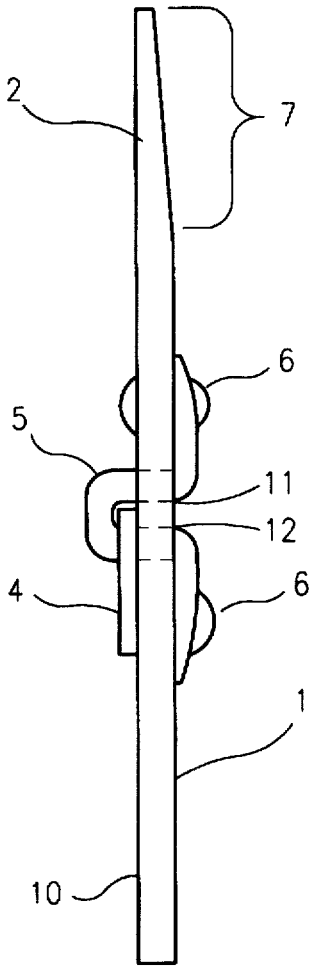
FIG. 2 is a side view of the present invention.

Referring now to FIG. 2, the swiveling arrangement of ring 4 is shown. A strap 5 of belting leather is attached by means of first rivet 6 to the rear side of body 1 and thence through a first horizontal elongate aperture, 11 formed in body 1. Strap 5 is then lead through the opening of ring 4, back through a second horizontal elongate aperture, 12 further formed in body 1, and again riveted to the rear side of body 1 using a second rivet 6. Alternative methods for attaching strap 5 to body 1, as well as alternatives for strap 5 itself include, but are not limited to adhesives, snaps, and other mechanical fasteners well known to those of ordinary skill in the art.

Alternative to the use of ring 4 previously discussed, microphone clip 21 may be disposed through the first and second horizontal elongate apertures defined by body 1 without implementing ring 4 or additional keeper elements.

In order to facilitate the insertion of a wearer's button through vertical elongate aperture 3, a portion of elongate arm 2 may be thinned or skived as shown at 7.

Figure 3:
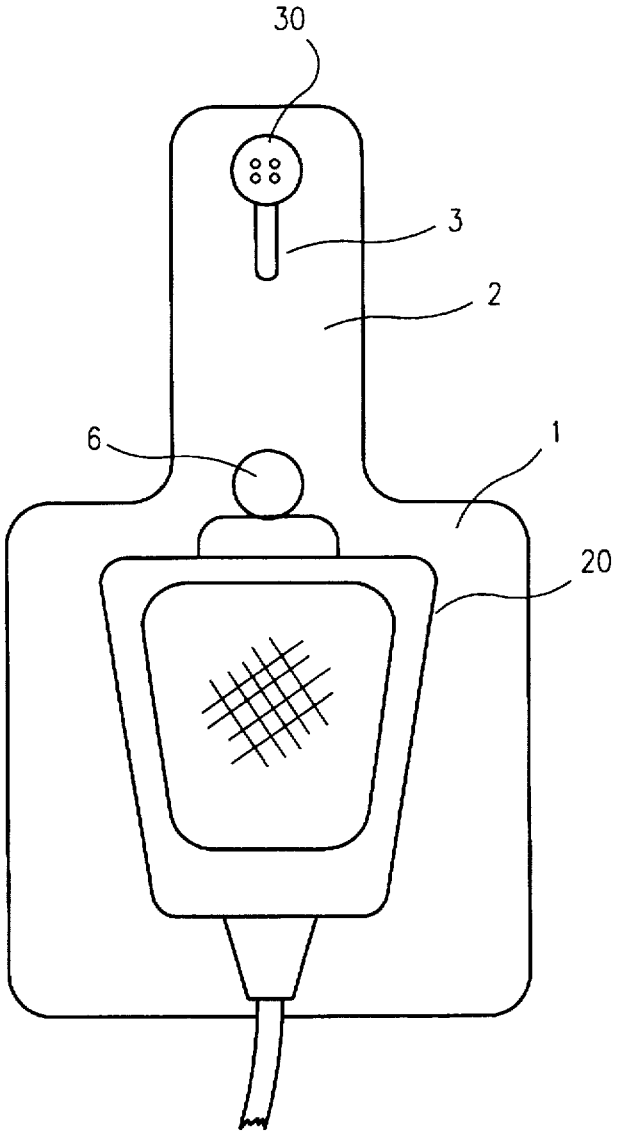
FIG. 3 is a front view of the present invention worn on the button of a wearer's uniform, and having a tactical microphone attached thereto.

Referring now to FIG. 3, the present invention is shown attached to a wearer's button 30, and having a tactical microphone 20 attached thereto. Body 1 is larger in outline that microphone 20, thereby minimizing the rotation or other movement of microphone 20 about clip 21.

Figure 4:
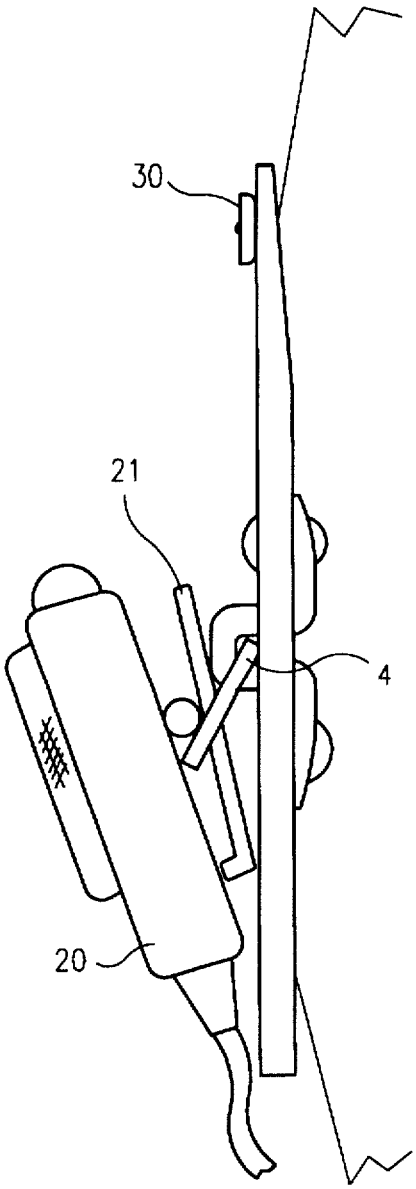
FIG. 4 is a side view of the present invention worn on the button of a wearer's uniform and having a tactical microphone attached thereto.

The attachment of microphone 20 to the present invention is detailed in FIG. 4. Microphone clip 21 is grippably received within the opening of ring 4.

It will be immediately apparent to those of ordinary skill in the art that alternative materials, external forms, and ring mounting methodologies may all be used to practice the present invention. The invention taught herein specifically contemplates the use of such alternative materials, forms, and ring mounting methodologies.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. The invention illustratively disclosed herein may be practiced without any element which is not specifically disclosed herein.

We claim:

1. A microphone holder adapted for removable attachment to a user's apparel and for removably securing thereto a microphone, the microphone including a clip, the microphone holder comprising:

a leather body, sized to be larger in outline than the microphone, the body defining an elongate arm at an upper end and first and second horizontal apertures, the elongate arm further defining a vertical aperture at the distal end thereof;

a square ring disposed on the body for receiving therein the microphone clip;

first and second rivets; and a leather strap, disposed through the first horizontal aperture and secured at a first end to the body with the first rivet, further disposed through the square ring and through the second horizontal aperture, and secured at a second end to the body with the second rivet.

2. A holder adapted for removable attachment on a user's apparel and for removably securing to said holder an apparatus, the apparatus including a securing device, the holder comprising:

a flexible planar body;

first attachment means disposed on said body for removably attaching said body to said apparel; and keeper means, further disposed on said body, for removably receiving therein said securing device of said apparatus, said keeper means including (a) a ring attached to said body and suitably sized to receive therein said securing device, and (b) second attachment means for attaching said ring means to said body, said second attachment means including (1) said body further defining first and second horizontal elongate apertures therethrough, (2) first and second securing means, and (3) a leather strap, disposed through said first horizontal elongate aperture and secured at a first end to said body with said first securing means, further disposed through said ring and through said second horizontal elongate aperture and secured at a second end to said body with said second securing means.

3. The holder of claim 2 wherein at least one of said first and said second securing means is selected from the group consisting of rivets, adhesive, and snap fasteners.

* * * * *